United States Patent [19]
Garner et al.
[11] 4,231,438
[45] Nov. 4, 1980

[54] STRAIGHT HOLE INSERT DRILL BIT

[75] Inventors: Lloyd L. Garner, San Clemente; Charles R. Harris, Whittier, both of Calif.

[73] Assignee: Smith International, Inc., Newport Beach, Calif.

[21] Appl. No.: 949,783

[22] Filed: Oct. 10, 1978

Related U.S. Application Data

[63] Continuation of Ser. No. 824,519, Aug. 15, 1977, abandoned.

[51] Int. Cl.[2] ..... E21B 9/10
[52] U.S. Cl. ..... 175/353; 175/374
[58] Field of Search ..... 175/374–378, 175/353, 410

[56] References Cited

U.S. PATENT DOCUMENTS

| | | | |
|---|---|---|---|
| 2,687,875 | 8/1954 | Morlan et al. | 175/374 |
| 2,994,390 | 8/1961 | Hildebrandt | 175/374 X |
| 3,239,431 | 3/1966 | Knapp | 175/331 |
| 3,452,831 | 7/1969 | Beyer | 175/374 |
| 3,461,983 | 8/1969 | Hudson et al. | 175/375 |

*Primary Examiner*—James A. Leppink
*Attorney, Agent, or Firm*—Robert M. Vargo

[57] ABSTRACT

A drill bit is disclosed for maintaining a desired direction of drilling or to reduce the deviation already established. The drill bit includes a plurality of legs with each leg having a cone cutter rotatively supported thereon. A plurality of annular rows of cutting inserts are circumferentially mounted on the conical surface of each cutter. Each cone cutter further includes a heel portion adjacent the base of the conical surface. The heel portion is of sufficient mass to support the gage row of cutting elements. The gage row of each cone extends further out from the cone axis than any of the intermediate adjacent rows in such a manner that the annular area of the hole bottom cut by the gage inserts is lower than any other area cut by the intermediate rows of cutting inserts. This extended gage row construction enables the gage inserts to cut into any sloping wall to produce a sharp corner and bring the hole back into line with the drill string. The cutting inserts of each gage row include relatively large cutting faces in the direction of the sidewalls of the bore hole in order to have substantial surface contact with the gage of the bore hole.

2 Claims, 7 Drawing Figures

STRAIGHT HOLE INSERT DRILL BIT

CROSS REFERENCE TO RELATED APPLICATION

This application is a continuation in part of U.S. patent application Ser. No. 824,519, filed Aug. 15, 1977 now abandoned.

BACKGROUND OF THE INVENTION

1. Field of the Invention

The present invention relates to drill bits with rotating cone cutters having a plurality of annular rows of inserts projecting therefrom.

2. Description of the Prior Art

The use of insert-type drill bits for drilling extremely hard formations has been known in the oil industry for many years. Such drill bits conventionally comprise two or three legs welded together to form a unitary structure. The one end of the structure forms a threaded shank for attachment to the lower end of a drill stem. The lower end of each leg includes an inwardly facing spindle for rotatively supporting a cone cutter having a plurality of annular rows of cutting inserts mounted thereon. Upon rotation of the drill bit, the cone cutters are adapted to substantially roll on the bottom of the hole to be drilled. During this rolling movement, the cutting inserts are disposed to contact and disintegrate the earth formation at the hole bottom. The chips and cuttings, dislodged from the earth formation, are flushed away by the drilling fluid passing across the face of the bored hole.

In a conventional 2- or 3-cone drill bit, a row of cutting inserts are provided at the heel of each cone to cut the bore hole to gage while other annular rows are spaced inwardly on the cones to cut the remainder of the bore hole bottom. In such conventional drill bits, the cones are configured with rounded heels to enable the gage row to have a shorter extension than the adjacent rows thereby alleviating the wear of the gage rows during the drilling operation. However, in such a configuration, the rounded heels and the lesser extending gage rows engage the hole bottom last thereby causing the drill bit to follow any deviation already existing in the bore hole. As a result, the drill bit would veer from its desired direction of travel.

A previous solution to this problem is found in U.S. Pat. No. 3,452,831. In the drill bit described in that patent, the gage row of inserts extends out radially further than the adjacent rows of inserts. However, any beneficial results of the gage row is negated by the reaming row of inserts located directly behind the gage row. The shortcoming with the reaming row is that it takes away from the support mass of the cone heel. As a result, the limited support of the gage row of inserts only allows for a point contact with the gage of the bore hole. Anything more than this minimal contact with the gage row would cause the gage inserts to break off from the cones.

SUMMARY OF THE INVENTION

The present invention obviates the above-mentioned shortcoming by providing a drill bit that can maintain its desired drilling direction or reduce the deviation already established.

In its broadest aspect, the present invention pertains to a drill bit of the cone cutter-insert type in which the gage rows of cutting inserts extend further out from the cone axis than the adjacent intermediate annular rows to the extent that the bottom hole area cut by the gage inserts is lower than any other area cut by the intermediate rows. This extended gage row construction produces cones having sharp corners between the bore hole wall and bottom, thereby enabling the gage inserts to cut into any sloping wall of the borehole to bring the borehole back into line with the drill string.

A primary advantage of the present invention is that the cone cutter includes a heel portion of sufficient mass to adequately support the gage row of inserts. This enables the gate inserts to have large gage cutting faces in order to have substantial surface contact with the gage of the borehole.

The features of the present invention, which are believed to be novel, are set forth with particularity in the appended claims. The present invention, both as to its organization and manner of operation, together with the further advantages thereof, may best be understood by reference to the following description taken in connection with the accompanying drawings.

DESCRIPTION OF THE PREFERRED EMBODIMENT

Figure 1:
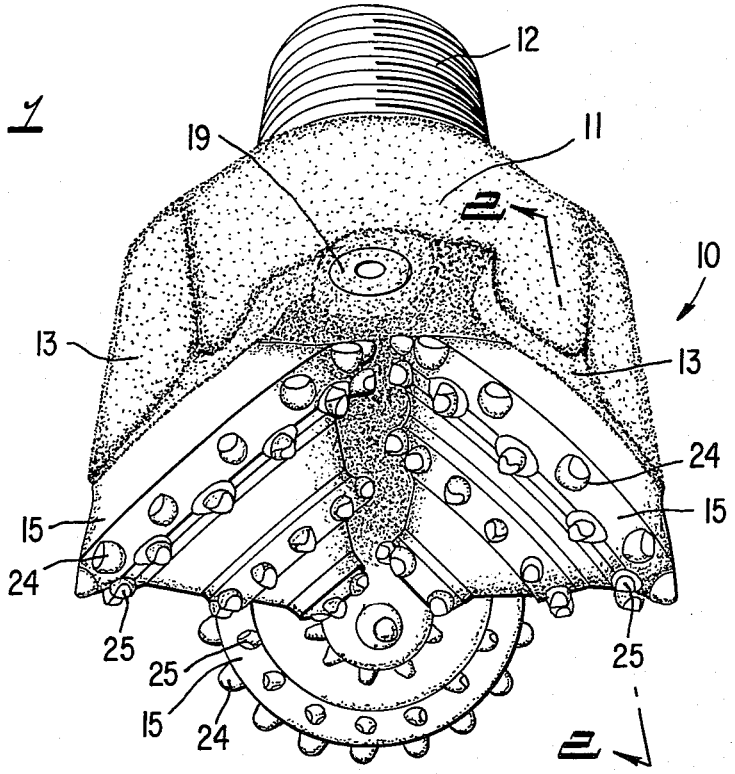
FIG. 1 is a perspective view of a three-cone bit embodying the present invention.

Referring now to the drawings, FIG. 1 illustrates a three-cone drill bit generally indicated by arrow 10 comprising a head 11 having a threaded shank 12 for attachment to the lower end of a drill string or stem. Three legs 13 extend downwardly from the head 11 with each leg 13 having a spindle or journal 14 extending downwardly and inwardly therefrom, one of which is shown in FIG. 2.

A generally conical roller cutter 15 is rotatively supported on each spindle or journal 14 by suitable friction bearings 16 and 18 and ball bearings 17. The bearing arrangement can be of many forms and the foregoing is illustrated as one of the more conventional types.

The head 11 further defines passageways in which the nozzles 19 are positioned to direct drilling fluid across the bottom face of the borehole.

Figure 2:
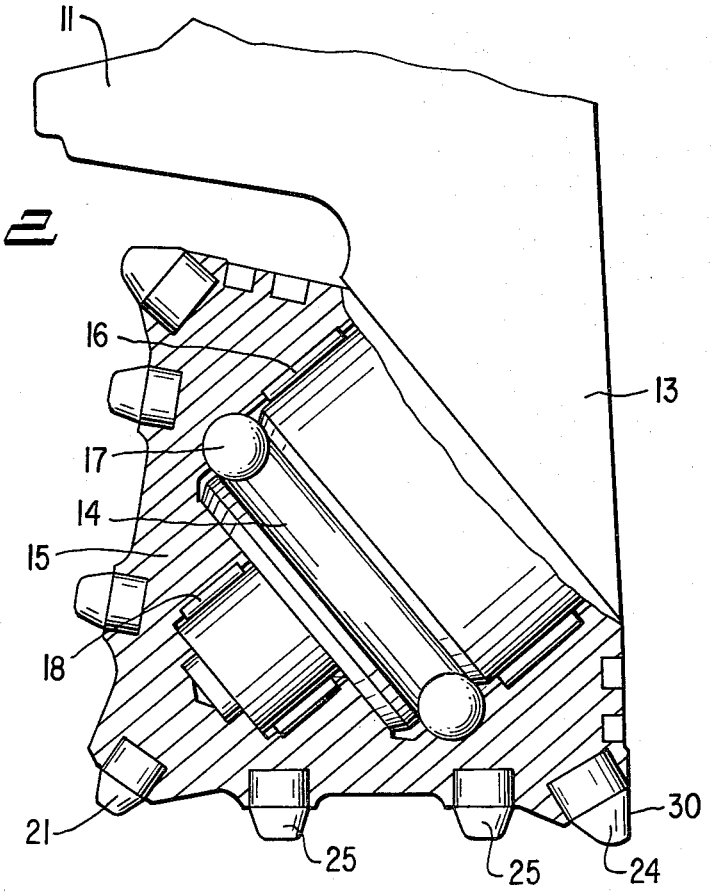
FIG. 2 is a sectional view of a No. 1 cone, illustrating the radially extended gage row in accordance with the present invention.
Figure 3:
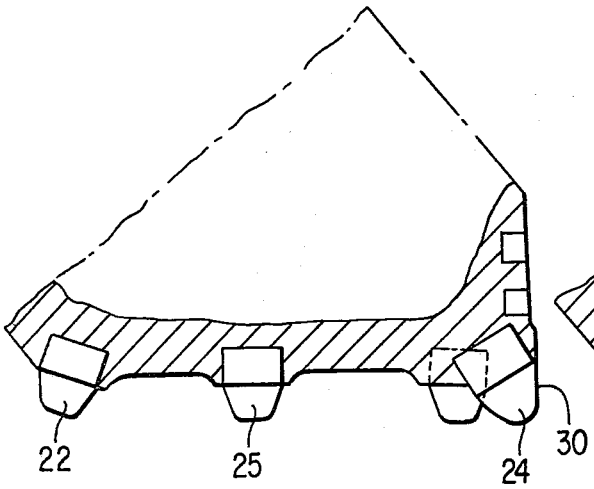
FIG. 3 is a fragmentary sectional view of a No. 2 cone of the present invention.
Figure 4:
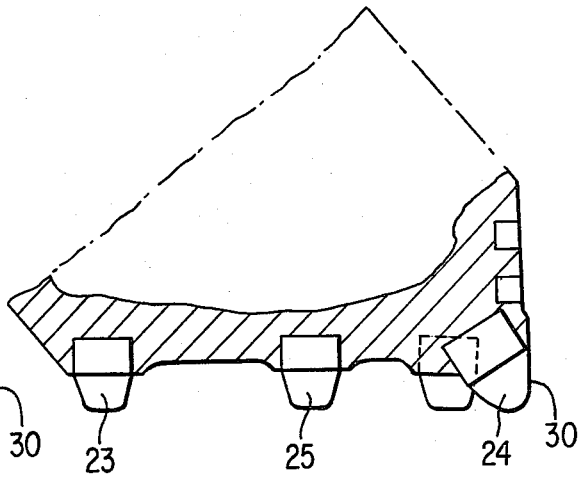
FIG. 4 is a fragmentary sectional view of a No. 3 cone of the present invention.

FIGS. 2, 3 and 4 illustrate the Number 1, 2 and 3 cones, respectively, of the drill bit 10. Each cone or cutter 15 includes a plurality of inserts arranged in rows mounted thereon. These inserts are preferably made of tungsten carbide. The No. 1 cone as shown in FIG. 2 includes a spear point 21 approximately at the longitudinal axis of the bit. The innermost row 22 of inserts of the No. 2 cone is the next outwardly row from the spear point of the No. 1 cone while the innermost row 23 of inserts on the No. 3 cone is the next outwardly row. These rows of inserts function to cut away the formation near the center of the well bore.

Each cone 15 also includes an annular gage row 24 of inserts that are located adjacent to the base of the conical surface and the heel 29 of the cone. The gage inserts 24 cut the intersection between the well bore wall and the bottom of the bore. Between the nose inserts 21 and the gage row 24 of each cone are located one or more intermediate rows 25 of inserts circumferentially disposed thereon.

Figure 5:
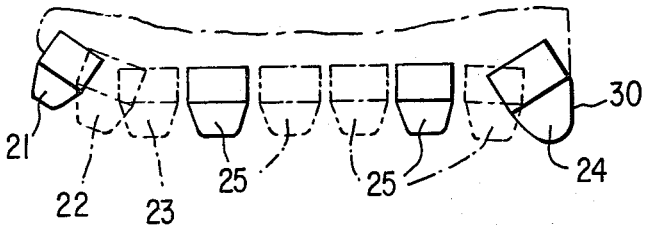
FIG. 5 is a superimposed view of the inserts of the cutter illustrated in FIGS. 2, 3 and 4 showing the bottom profile of a portion of a well bore bottom as the drill bit is rotated in the well bore.

The arrangement of the inserts in the various rows is best shown in FIG. 5. In this FIGURE the inserts of the No. 1 cone are shown in solid lines, while the inserts of the No. 2 and 3 cones are shown in phantom. The number of inserts vary from row to row, but such numbers are not necessary for this description.

Turning now to a more particular description of the invention, it should be noted that the cones are configured to have relatively "flat bottoms". This is accomplished by having the peripheral profile of each cone approximate a pair of straight lines and by having the gage row 24 extend radially outward from the cone axis beyond that of the adjacent intermediate rows of inserts. In the preferred embodiment, the gage row extends more than ten percent further in a radial direction than the adjacent intermediate rows. For example, in a rock bit having a gage diameter of $12\frac{1}{4}$ inches, the radial distance of the gage row for the No. 1 cone is approximately 3-15/16 inches and the adjacent row is $3\frac{1}{8}$ inches. In this example, the gage row has a radius that is approximately 26% larger than the radius of the adjacent row. This is also shown in FIG. 2 in which the cone has been drawn to scale and the radius of the gage row is approximately 26% greater than the radius of the adjacent row. Because of this extended gage row construction, the gage rows contact the bottom of the borehole first and cut a deeper annular area at the hole bottom than the nose and intermediate rows of inserts. The extended gage rows also enable the cones to produce a sharp corner between the hole wall and bottom. As a result, the extended gage inserts tend to cut into any sloping wall to bring the hole back into line with the drill string.

An important part of the present invention is that the cones 15 have heel portions 29 that extend parallel to the side of the bore hole. This enables the heel portions 29 to have sufficient mass to adequately support the gage inserts 24.

Figure 6:
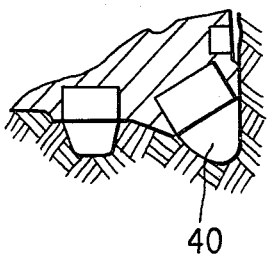
FIG. 6 is a fragmentary sectional view of a second embodiment of the present invention.
Figure 7:
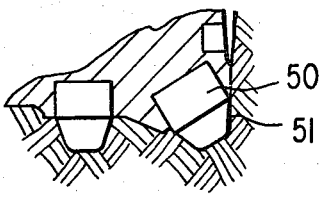
FIG. 7 is a fragmentary sectional view of a third embodiment of the present invention.

In the preferred embodiment, the gage inserts 24 are projectile type inserts in which a flat surface 30 is machined off at an angle sufficient to enable the surface to be parallel with the hole wall. However, as shown in FIG. 6, a regular projectile type insert 40 can be utilized as the gage inserts, or as shown in FIG. 7, a chisel insert 50 having a machined surface 51 can be utilized in a similar manner. The adequate support of the heel portions 29 enables the gage inserts 24 to have substantial surface contact with the gage of the borehole without breaking off.

As can be seen, a novel drill bit is provided which can maintain a straight hole without deviation or which can reduce the deviation already established.

It should be noted that various modifications can be made to the assembly while still remaining within the purview of the following claims. For example, although a three cone bit has been described, the present invention would operate equally as well in a two cone bit.

What is claimed is:

1. A rotary drill bit comprising:

a main body having a plurality of legs extending downwardly therefrom, each leg having an inwardly extending journal formed thereon, and a cone shaped cutter rotatively supported on each journal, the peripheral surface of each cutter having a plurality of annular rows of outwardly projecting cutting inserts mounted thereon with the outermost row of cutting inserts from the cone vertex forming the gage cutting row, at least one cone is configured to have the gage cutting row of inserts having a diameter larger by substantially 10% than that of the adjacent intermediate annular row of inserts, thereby enabling the extended gage row to produce a sharp corner between the borehole wall and bottom, each said cone including a heel portion adjacent said gage row, said heel portion having an outer surface parallel to the outer surface of said leg, each of said gage inserts including a cutting face parallel to the outer surface of said heel portion, each of said cones having its peripheral surface roll on the bottom of the borehole and being configured to have the gage cutting row of inserts extending downwardly further than the other annular rows of inserts thereby cutting an annular area on the borehole bottom lower than the area cut by the inner annular rows of inserts.

2. The combination of claim 1, wherein the gage cutting row of each said cone has a diameter larger by at least 15% than that of the adjacent intermediate annular row of inserts.

* * * * *